US005103507A

United States Patent [19]

Sprajc et al.

[11] Patent Number: 5,103,507

[45] Date of Patent: Apr. 14, 1992

[54] TOILET FLUSH VOLUME CONTROL DEVICE

[76] Inventors: Anton Z. Sprajc; Gordana Sprajc, both of 255-01 41st Ave., Little Neck, N.Y. 11363

[21] Appl. No.: 651,526

[22] Filed: Feb. 6, 1991

[51] Int. Cl.[5] ..... E03D 1/14; E03D 3/12

[52] U.S. Cl. ..... 4/324; 4/415

[58] Field of Search ..... 4/324, 325, 415

[56] References Cited

U.S. PATENT DOCUMENTS

| | | | |
|---|---|---|---|
| 3,108,286 | 10/1963 | Moore | 4/325 |
| 3,561,016 | 2/1971 | Reynolds | 4/324 |
| 3,790,968 | 2/1974 | Pfeifer | 4/324 X |
| 4,032,997 | 7/1977 | Phripp et al. | 4/415 |
| 4,120,056 | 10/1978 | Phripp et al. | 4/324 |
| 4,183,107 | 1/1980 | Hare et al. | 4/324 |

*Primary Examiner*—Charles E. Phillips

*Attorney, Agent, or Firm*—Kevin E. Kavanagh

[57] ABSTRACT

A limited flush retrofit control device for toilet tanks is useable on both ball valve tanks and flapper valve tanks. A U-shaped horizontal thrust member with vertical arms attached to each side acts to effect closing of a ball valve or flapper valve as its up-or-down motion is controlled in a desired path by horizontal guide means attached to the tank overflow pipe and engaging the vertical arms of the U-shaped thrust member. Each vertical arm is fitted with a float, adjusting clips and preferably with weights. The adjustable clips determine the heights of the float on the vertical arm. The flush volume prior to reseating the ball valve or flush valve by the thrust member is a function of the position of the floats on the vertical arms. A full flush is effected by maintaining the tank lever arm in the flush position until the tank is emptied.

8 Claims, 2 Drawing Sheets

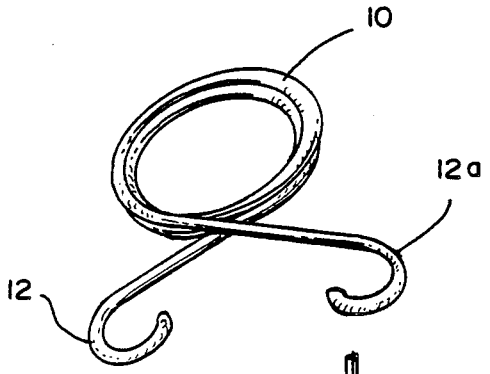
FIG. 4
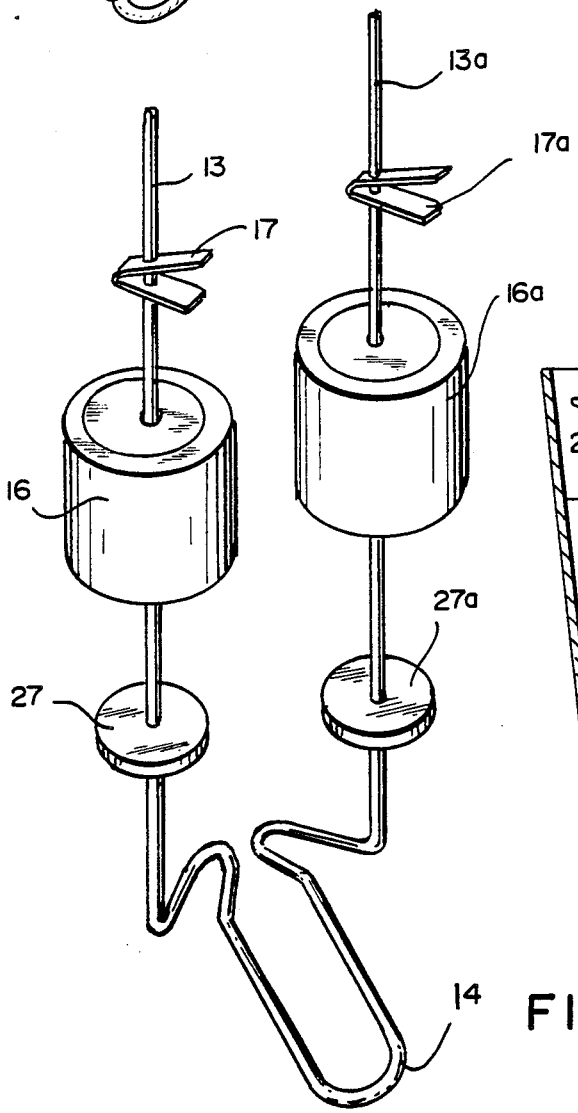
FIG. 5
FIG. 3
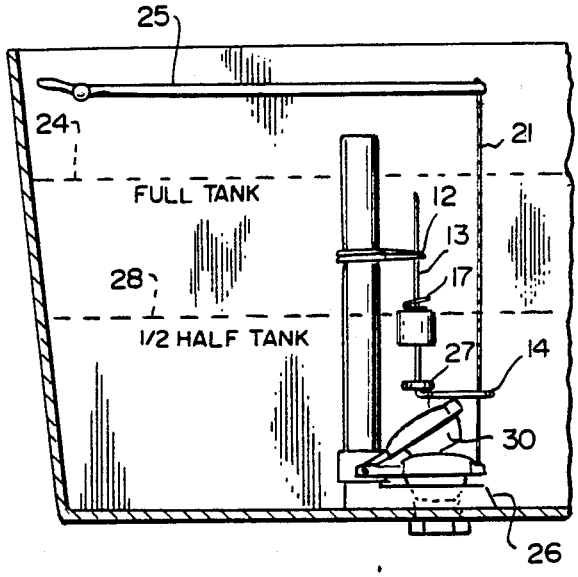

TOILET FLUSH VOLUME CONTROL DEVICE

BACKGROUND OF THE INVENTION

The toilet tanks in homes and apartments more than 5 years old hold 5 gallons of water and use essentially all of this volume with each flush. With the recognition in recent years that water is a valuable resource and in short supply in many areas of the country, modern toilet tanks have been designed to accomplish toilet bowl evacuation with as little as 1½ to 2½ gallons per flush.

This invention provides a retrofit device for older toilet tanks; it is economical, simply installed and permits either a restricted volume flush or full volume flush. Unlike many previous devices designed to restrict water flow from toilet tanks, the retrofit device of this invention is useable with toilet tanks having either a flapper valve or a ball valve closure on the outlet port to the toilet.

PRIOR ART DEVICES

Stevens U.S. Pat. Nos. 4,748,699 and 4,937,895 disclose devices for restricting the volume of flush in flapper valve toilet tanks. Stevens' devices which involve a float slidably mounted on the tank overflow tube are not useable on ball valve toilet tanks because of the clamp holding the guide arm for the ball valve present on the overflow pipe. Jomha et al. U.S. Pat. No. 4,945,578 also discloses a device designed to restrict the flush volume in a flapper valve toilet tank; it uses a float device slidably mounted on the overflow standpipe and cannot be used with a toilet tank having a ball valve type closure for the same reason. Battle U.S. Pat. No. 4,651,359 also mounts his float device on the overflow standpipe and is usable solely with flapper valve type toilet tanks.

In contrast Phripp et al. U.S. Pat. No. 4,120,056 restricts the flush volume in a ball valve type tank; his device is not useable with flapper valve tanks because his regulator is mounted on the vertical stem of the ball valve. Similarly Reynolds U.S. Pat. No. 3,561,016 provides a device to control the flush volume in a ball valve tank; its hat-shaped member which fits over the ball valve and which depresses the ball valve after the restricted flow into the bowl cannot be employed with a flapper valve.

The limited flush control device of this invention unlike these prior art devices works equally well with either flapper valve or ball valve tanks. In addition it can be simply and quickly installed by the homeowner obviating the necessity of professional help. It is also inexpensive to manufacture so that its cost will not restrict its use. Its simplicity of design, ease of installation and affordability will encourage its widespread use with resultant significant water conservation.

SUMMARY OF THE INVENTION

The limited flush control device of this invention comprises six discrete components which are simply assembled. They are the following: a clamp which fits on the tank overflow pipe and which supports two guide arms extending horizontally from the overflow pipe; a U-shaped horizontal thrust member which has two vertical arms; two float members; and two adjusting clips. In the peferred embodiment it also has two weights.

The clamp is preferably a wire spring clamp which is readily placed over the overflow pipe by squeezing the guide arms; once in place it firmly engages the standpipe. Each horizontal guide arm terminates in a loop which is preferably open. Each weight and float includes a center hole for placement on the vertical arms of the U-shaped thrust member; the weights which impart balance to the device and assist the guide arms in controlling the thrust member's vertical motion are first placed on the vertical arms followed by the floats. Finally the adjustable clips are placed on the vertical arms. The vertical arms of the thrust member, together with a weight, float and adjustable clip on each arm, are then inserted into the open guide loops of the horizontal arms of the clamp.

The mode of operation of this invention, its simplicity of installation and its operability with both flapper valve and ball valve tanks are demonstrated in the attached drawings and description.

It is a primary object of this invention to provide a novel retrofit mechanism for a toilet tank which reduces the amount of water required to effectively flush a toilet.

IN THE DRAWINGS

FIG. 3 is similar to FIG. 1 showing the flush control device in a flapper valve tank after the tank has half emptied during a flush.

FIG. 4 is a plan view of the spring clamp with its horizontal guide means which engage the two vertical arms of the U-shaped thrust member so that its up and down motion is maintained in the proper plane.

FIG. 5 is a plan view of the U-shaped thrust member.

The novel retrofit mechanism of this invention will be described hereinafter as utilized in a normally structured toilet tank. Functionally the tank is associated with a toilet in a manner to deliver a rapid stream of water in response to manual activation by a handle external to the tank.

The toilet tank is connected with a water source. The flow control mechanism comprises a water shut-off valve activated by a conventional float mechanism and an overflow standpipe which allows water entering the tank to safely overflow into the toilet in the event of malfunction of the entry water flow control device. The tank contains a relatively large outlet or drain port in communication with the toilet. The outlet port is fitted with a flapper valve or ball-type valve which, on the removal from the outlet port by activation of the external handle permits a flush to commence.

Figure 1:
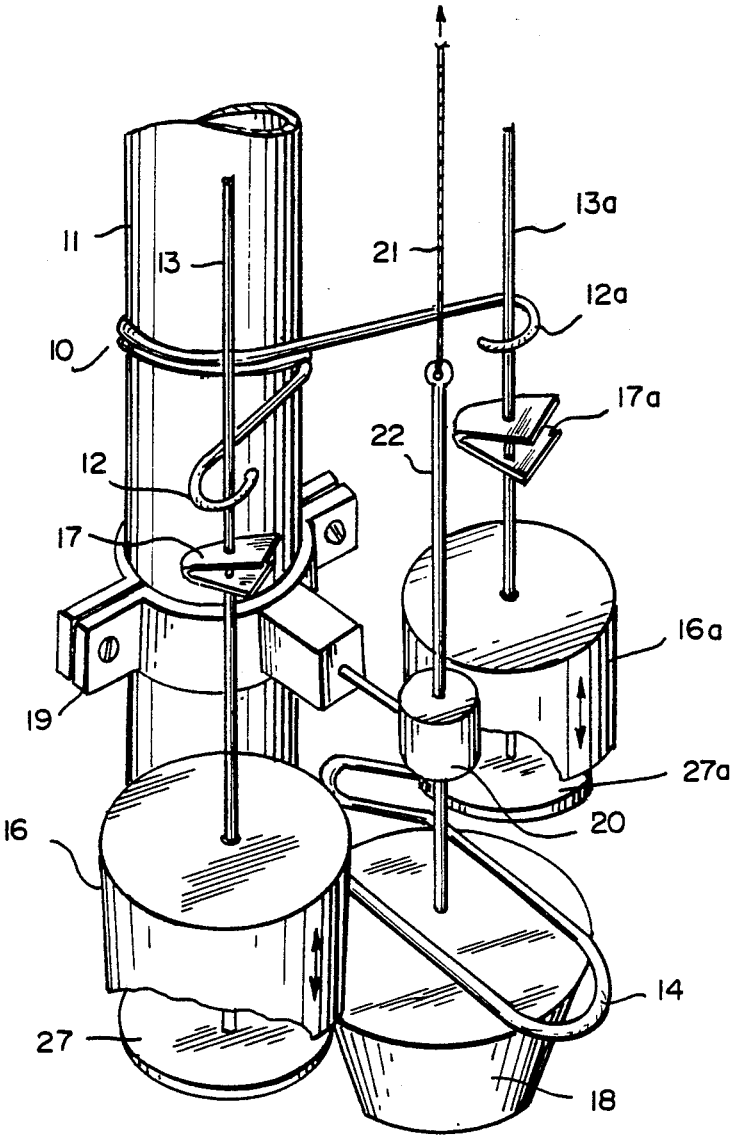
FIG. 1 is an isometric elevation view of the flush control device of this invention attached to an overflow standpipe.

Referring to FIGS. 1 and 4, a spring clamp 10 is secured on a tank overflow standpipe 11. Horizontal guide members 12 and **12*a* of the spring clamp 10 slideably engage the vertical arms 13 of a U-shaped thrust member 14 to control the latter's up and down motion. Float members 16 and 16*a* as well as adjusting clips 17 and 17*a* are shown on the vertical arms which preferably contain weights 27 and 27*a*. A ball valve 18 is shown under the U-shaped thrust member; its positioning in the tank drain outlet after a flush is controlled by valve guide 20 secured in position by clamp 19 on the overflow pipe 11. The vertical stem 22 of the ball valve 18 passes through a valve guide 20; a chain 21** connects to stem 22 and raises the ball valve from the tank outlet through a lever arm which is activated by an external handle.

Figure 2:
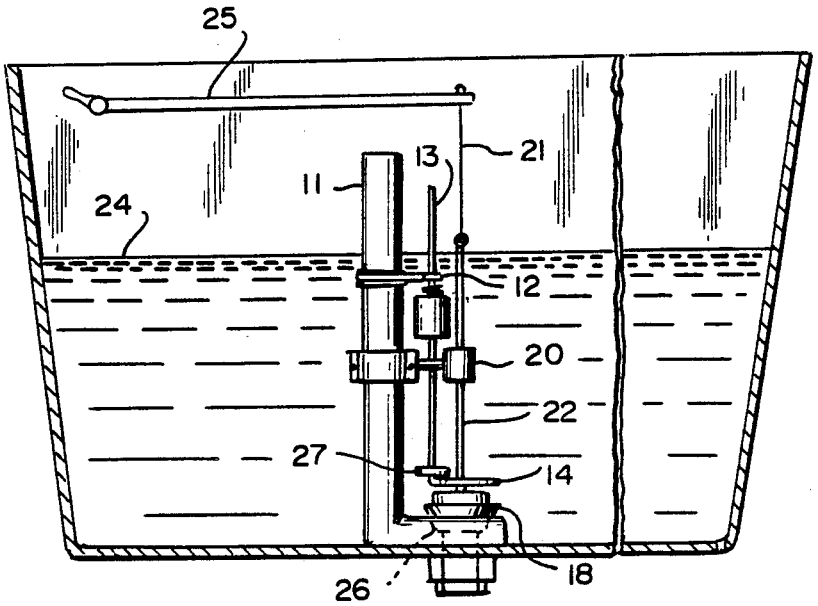
FIG. 2 is a front elevation of a ball valve tank with the flush control device of this invention installed and ready for operation.

Referring to FIG. 2 the flush control device of this invention is installed in a ball valve tank. Not shown but heretofore described are the conventional water inlet standpipe, water inlet control valve and water inlet control float which closes the water inlet control valve when the water reaches a predetermined level in the tank. In FIG. 2, the water in the tank is preset to reach a predetermined level 24 before the tank is ready for flushing by raising the lever arm 25 by the action of a handle exterior to the tank. The ball valve 18 is thus lifted from the tank outlet 26 as the lever arm 25 tightens the chain 21 and the stem 22 attached thereto. The stem 22 passes through the valve guide 20 which is maintained in proper alignment by clamp 19 to assure reseating of the ball valve 20 in the tank outlet 26. The device of this invention is shown in FIG. 2 just prior to flushing. The spring clamp 10 is secured on the overflow standpipe 11 with its horizontal guide means 12 engaging a vertical arm 13 of the U-shaped thrust member 14. A float 16, adjustable clip 17 and weight 27 are shown on vertical arm 11. As the water level falls or rises, the U-shaped thrust member 14 also falls or rises and passes over the ball valve guide 20 attached to overflow pipe 11 by clamp 19.

As the water level drops while the water flows into the toilet bowl, the U-shaped thrust member falls, contacts the ball valve 18 and reseats it in the tank outlet port 26. Advantageously this occurs when the tank has half-emptied since under most circumstances such water volume is adequate to cause a siphon effect in the toilet bowl. The adjustable clips 17 provide a simple means for raising or lowering the floats 16 on vertical arms 13 with a concomitant change in the amount of water that exits the tank before the device of this invention shuts off the water flow from the tank by forcing the ball valve 18 into the tank outlet 26. By lowering the clips 17 on the vertical arms 13, a greater portion of the water exits the tank prior to the device of this invention forcing the ball valve 18 into the tank outlet 26 and shutting off the water flow into the toilet bowl. Conversely raising the clips 17 on the vertical arms 13 reduces the amount of water exiting the tank before closure of the tank outlet 26 is effected by the device of this invention.

FIG. 3 shows a flapper valve tank in which the controlled flush device of this invention is about to effect closure of the flapper valve 30 into the tank outlet 26 after about half the water initially in the tank has emptied into the toilet bowl. The full tank water line is shown as dotted line 24 and one half flush line is shown as dotted line 28. A flapper valve 30 is being forced into the tank outlet 26 by the U-shaped thrust member 14 when about one-half the tank water content empties into the toilet bowl thorugh the tank outlet 26. The flapper valve 30 is raised to an open position by a chain 31 attached to a lever arm 25. As in FIG. 2, the guide means 12 secured on the standpipe 11 by a spring clamp 10 controls the up and down motion of the U-shaped thrust member 14 by engaging its vertical arms 13 and 13*a*.

FIG. 4 shows the preferred means for controlling the up and down motion of the U-shaped thrust member, namely a spring clamp 10 with its horizontal guide members 12 and 12*a*; it is preferably made of stainless steel. It can be placed on the overflow standpipe 11 by pressing the guide members 12 and 12*a* inwardly to enlarge its openings; when the pressure on the guide members is released, the clamp 10 is secured on the overflow pipe 11.

FIG. 5 shows in greater detail a preferred embodiment of the U-shaped thrust member 14 with its vertical arms 13 and 13*a*. Weights 27 and 27*a* are preferably circular lead pieces with center holes for easy placement on vertical arms 13 and 13*a*. The floats 16 and 16*a* are preferably made from styrofoam because of its availability, durability and price. However, other well known float materials such as cork may also be used. The floats 16 and 16*a* also have an axial hole for ready placement on the vertical arms 13 and 13*a* as shown. FIG. 5 shows a preferred type of adjustable clip 17 and 17*a* formed from a thin strip of stainless steel which is bent in the middle after two holes have been punched in the strip. These clips are very effective in maintaining the floats 16 and 16*a* in the desired position on the vertical arms 13 and 13*a* of the thrust member 14.

It is apparent from FIGS. 2 and 3 that the controlled flush device of this invention is effective with both ball valve and flapper valve tanks. Its structure and its limited number of parts simplify its installation so that the average homeowner can install it in a short period of time without recourse to professional help. The spring clamp with its guide arms and the U-shaped thrust member are installed in a toilet tank without tools and without interferring with the mechanism needed for the operation of either a ball valve or flapper valve tank. Finally it is inexpensive to manufacture so that its cost will not be a deterrent to its use in conserving water.

It is also evident that a full flush can be effected when the retrofit device of this invention is installed in a toilet tank. The controlled flush results when the exterior handle raises the lever arm and is immediately released. To accomplish a full flush, the lever arm is retained in an elevated position by pressure on the exterior handle until the tank is emptied. The closing action of the retrofit device does not overcome the action of the lever arm in keeping the ball valve or the flapper valve from effecting closure of the tank outlet or drain.

This invention has been described in its presently known best mode and it is evident that modifications may be made by those skilled in the art. Accordingly the scope of this invention is defined by the following claims.

We claim:

1. A limited flush control device for toilet tanks having an outlet drain at the tank bottom fitted with a valve closure and an overflow standpipe adjacent to said outlet drain, comprising (a) two guide arms extending horizontally above said valve closure, means for receiving said guide arms on the overflow standpipe;

(b) a U-shaped horizontal thrust member for seating on said valve closure, said member having two vertical arms extending upwardly, one from each side of said thrust member, (c) a float on each of said vertical arms, (d) a clamp on each of said vertical arms for adjusting the float height on said vertical arms, (e) said guide arms engaging the vertical arms of the thrust member to control the up and down motion of the thrust member in the desired path in the tank.

2. A limited flush control device according to claim 1 in which a weight is placed on each vertical arm of the thrust member.

3. A limited flush control device according to claim 1 in which the horizontal guide arms are secured to the tank overflow pipe by a spring clamp.

4. A limited flush control device according to claim 1 in which said floats are made from styrofoam.

5. A limited flush control device according to claim 1 in which said spring clamp and horizontal guide means are one integral unit wherein the horizontal guide arms serve as the tension members for the spring clamp.

6. In a toilet tank engaging a toilet for discharging a flow of water into the latter, which tank includes:

means forming a tank water flow system including a pipe communicating with a water supply, an outlet port at the tank lower end communicated with said toilet, a valve element positioned in said outlet port being operable to an open position for allowing water from the tank to flow into said toilet, a handle positioned externally of said tank and including means engaging said valve for lifting the same from said outlet port to initiate said flow of water and a standpipe in said tank adjacent to said discharge port, a device used therein for regulating the flow of water passing through said outlet port when said outlet valve is actuated from the closed position, which includes (a) a guide member depending from said standpipe and having at least two outstanding arms, each thereof having a guide loop at the arm end, (b) a U-shaped horizontal thrust member having two vertical arms extending upwardly, one from each side of said thrust member, (c) a float and a weight on each of said vertical arms, (d) a clamp on each of said vertical arms for adjusting the float height on said vertical arm, (e) the guide arms engaging the vertical arms of said thrust member to control the up and down movement of the thrust member in a desired path within the tank.

7. A device according to claim 6 used in a tank in which the valve element positioned in said outlet port is a ball-type valve.

8. A device according to claim 6 used in a tank in which the valve element positioned in said outlet port is a flapper valve.

* * * * *